US009896898B2

(12) United States Patent
Andersen et al.

(10) Patent No.: US 9,896,898 B2
(45) Date of Patent: Feb. 20, 2018

(54) PACKER END RING WITH POLYMER GRIPPING DEVICE

(75) Inventors: Kristian Andersen, Stavanger (NO); Solve S. Lyng, Rykkinn (NO)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 186 days.

(21) Appl. No.: 14/371,652

(22) PCT Filed: Mar. 1, 2012

(86) PCT No.: PCT/IB2012/000394
§ 371 (c)(1),
(2), (4) Date: Oct. 9, 2014

(87) PCT Pub. No.: WO2013/128222
PCT Pub. Date: Sep. 6, 2013

(65) Prior Publication Data
US 2015/0053396 A1 Feb. 26, 2015

(51) Int. Cl.
*E21B 33/12* (2006.01)

(52) U.S. Cl.
CPC ..... *E21B 33/12* (2013.01); *Y10T 29/49826* (2015.01)

(58) Field of Classification Search
CPC ..... E21B 2033/005; E21B 33/12; E21B 33/1208; E21B 33/1285; E21B 33/1293
See application file for complete search history.

(56) References Cited

U.S. PATENT DOCUMENTS

| | | | | |
|---|---|---|---|---|
| 3,818,987 | A | 6/1974 | Ellis | |
| 4,407,514 | A | 10/1983 | Hausler | |
| 7,059,415 | B2 | 6/2006 | Bosma | |
| 2008/0078561 | A1* | 4/2008 | Chalker | E21B 33/1208 166/387 |
| 2009/0139707 | A1* | 6/2009 | Berzin | E21B 33/1208 166/118 |
| 2009/0179383 | A1 | 7/2009 | Koloy et al. | |

(Continued)

FOREIGN PATENT DOCUMENTS

WO 2011110819 A2 9/2011

OTHER PUBLICATIONS

Specification and Drawings for U.S. Appl. No. 14/371,641, filed Jul. 10, 2014, 22 pages.

(Continued)

*Primary Examiner* — Caroline N Butcher
(74) *Attorney, Agent, or Firm* — Locke Lord LLP; Joshua L. Jones

(57) ABSTRACT

A packer can include an end ring positioned proximate a seal element on a base pipe, and a gripping device positioned in an annular space between the end ring and the base pipe, the gripping device comprising a polymer composition material. A method of constructing a packer can include positioning an end ring on a base pipe, and then injecting a gripping device into an annular space between the end ring and the base pipe, whereby the gripping device grips the base pipe. Another method of constructing a packer can include positioning a gripping device in an annular space between an end ring and a base pipe, so that the gripping device grips the base pipe, the gripping device comprising a polymer composition material.

38 Claims, 4 Drawing Sheets

(56) References Cited

U.S. PATENT DOCUMENTS

| | | | | |
|---|---|---|---|---|
| 2010/0138158 | A1 | 6/2010 | Nutley et al. | |
| 2011/0083861 | A1 | 4/2011 | Allison et al. | |
| 2012/0292023 | A1* | 11/2012 | Hinkie ..... | E21B 47/12<br>166/255.1 |

OTHER PUBLICATIONS

International Search Report with Written Opinion dated Sep. 26, 2012 for PCT Patent Application No. PCT/IB2012/000394, 10 pages.

International Search Report with Written Opinion dated Sep. 28, 2012 for PCT Patent Application No. PCT/IB2012/000384, 8 pages.

Downhole Products; "DHP Range of Products", webpage via http://www.downhole.org/products.html, Feb. 22, 2012, 2 pages.

Downhole Products; "Shrink-LOK—Twin Slimline", "Shrink-LOK—Twin", company specification brochure, received Feb. 23, 2012, 1 page.

Belzona; "Belzona 1591", Product Specification Sheet, Publication No. 4-7-10, dated 2010, 2 pages.

* cited by examiner

PACKER END RING WITH POLYMER GRIPPING DEVICE

CROSS-REFERENCE TO RELATED APPLICATION

This application is a national stage under 35 USC 371 of International Application No. PCT/IB2012/000394, filed on 1 Mar. 2012. The entire disclosure of this prior application is incorporated herein by this reference.

TECHNICAL FIELD

This disclosure relates generally to equipment utilized and operations performed in conjunction with a subterranean well and, in one example described below, more particularly provides a packer end ring with a polymer gripping device for gripping a base pipe.

BACKGROUND

Packers are used in wells to seal off annuli formed between tubular strings, or between a tubular string and another surface, such as a wall of a wellbore. It is important to construct packers so that they can reliably withstand substantial differential pressure, but it is also important to construct packers in an economical and expeditious manner.

Therefore, it will be appreciated that improvements are continually needed in the art of constructing packers for use in wells.

SUMMARY

In this disclosure, systems and methods are provided which bring improvements to the art of constructing packers. An example is described below in which a gripping device is contained in an end ring, so that the gripping device grips a base pipe and prevents longitudinal displacement of a seal element relative to the base pipe.

A packer is provided to the art by the disclosure below. In one example, the packer can include an end ring positioned proximate a seal element on a base pipe, and a gripping device positioned in an annular space between the end ring and the base pipe. The gripping device can comprise a polymer composition material.

A method of constructing a packer is also described below. In an example, the method comprises: positioning an end ring on a base pipe, and then injecting a gripping device into an annular space between the end ring and the base pipe, whereby the gripping device grips the base pipe.

Another method of constructing a packer can include: positioning an end ring on a base pipe, and positioning a gripping device in an annular space between the end ring and the base pipe, so that the gripping device grips the base pipe, the gripping device comprising a polymer composition material.

These and other features, advantages and benefits will become apparent to one of ordinary skill in the art upon careful consideration of the detailed description of representative embodiments of the disclosure below and the accompanying drawings, in which similar elements are indicated in the various figures using the same reference numbers.

DETAILED DESCRIPTION

Figure 1:
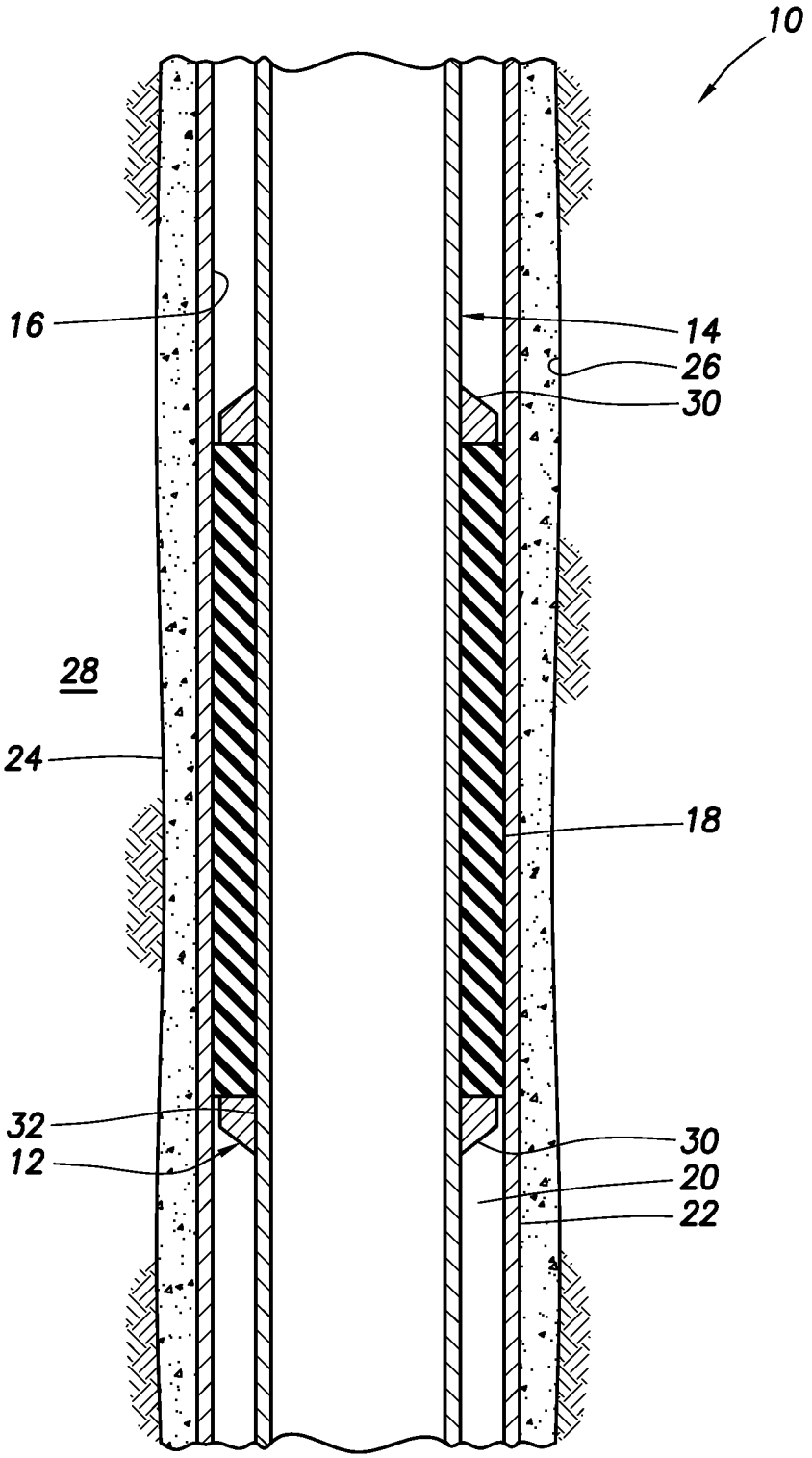
FIG. 1 is a representative cross-sectional view of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a packer 12 is interconnected in a tubular string 14 and positioned in a wellbore 16. The packer 12 includes a seal element 18 which extends radially outward into sealing engagement with the wellbore 16, thereby sealing off an annulus 20 formed radially between the tubular string 14 and the wellbore 16.

In this example, the wellbore 16 is lined with casing 22 and cement 24. In other examples, the wellbore 16 could be uncased or open hole, in which case the seal element 18 could sealingly engage a wall 26 of an earth formation 28 penetrated by the wellbore 16.

The seal element 18 can comprise a swellable material which swells in response to contact with a particular fluid in the well. The term "swell" (and similar terms, such as, "swellable," "swelling," etc.) is used herein to indicate an increase in volume of a material. A seal element can expand outward without swelling (e.g., as in inflatable or compression-set packers, etc.). However, if the material is to be considered swollen, the seal element material itself must increase in volume.

Preferably, the swellable material swells when it is contacted with a particular swelling fluid (e.g., oil, gas, other hydrocarbons, water, etc.) in the well. The swelling fluid may already be present in the well, or it may be introduced after installation of the packer 12 in the well, or it may be carried into the well with the packer, etc. The swellable material could instead swell in response to exposure to a particular temperature, or upon passage of a period of time, or in response to another stimulus, etc.

End rings 30 longitudinally straddle the seal element 18 on a base pipe 32, in order to restrict longitudinal displacement of the seal element 18 on the base pipe 32. In most situations, it is desired for the end rings 30 to substantially prevent any displacement of the seal element 18 relative to the base pipe 32, so that a desired differential pressure can be sealed against in the annulus 20.

The end rings 30 may directly abut opposite longitudinal ends of the seal element 18 as depicted in FIG. 1. In other examples, components such as backup rings, etc. may be interposed between the end rings 30 and the seal element 18.

In further examples, multiple seal elements 18 could be straddled by the end rings 30, and an end ring could be positioned between a pair of seal elements. Thus, it should be clearly understood that the scope of this disclosure is not limited at all to any of the details of the packer 12, or seal element 18, end rings 30 and base pipe 32, as illustrated in the drawings or described herein.

Figure 2:
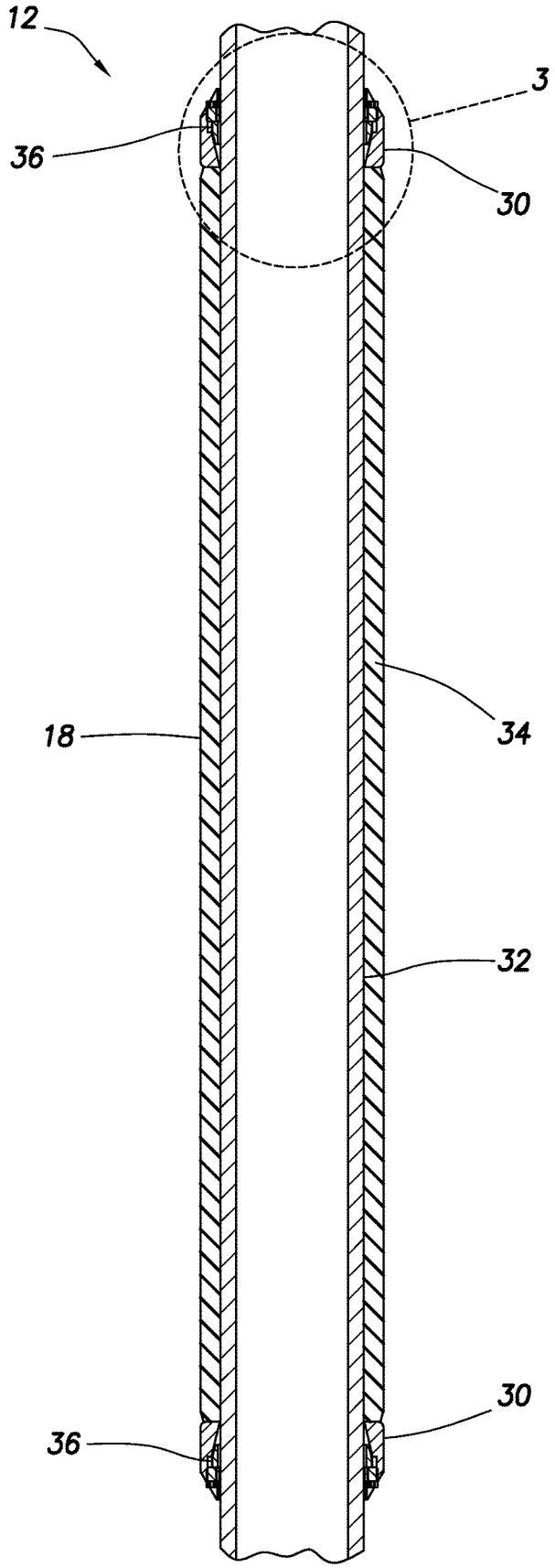
FIG. 2 is an enlarged scale representative cross-sectional view of a packer which may be used in the system and method of FIG. 1, and which can embody the principles of this disclosure.

Referring additionally now to FIG. 2, an enlarged scale cross-sectional view of the packer 12, apart from the remainder of the FIG. 1 system 10, is representatively illustrated. The packer 12 could, however, be used in other systems and methods, in keeping with the scope of this disclosure.

In this view, it may be seen that the seal element 18 comprises a swellable seal material 34, and encircles the base pipe 32. The base pipe 32 may be provided with end connectors (not shown) for interconnecting the packer 12 in the tubular string 14.

The end rings 30 are positioned at opposite ends of the seal element 18. The end rings 30 can serve to protect the seal element 18 as the packer 12 is being conveyed into the wellbore 16, as well as to prevent displacement of the seal element 18 relative to the base pipe 32.

In the FIG. 2 example, a gripping device 36 is positioned in each of the end rings 30. The gripping devices 36 secure the end rings 30 against longitudinal displacement relative to the base pipe 32, so that the seal element 18 is also secured against longitudinal displacement relative to the base pipe.

Figure 3:
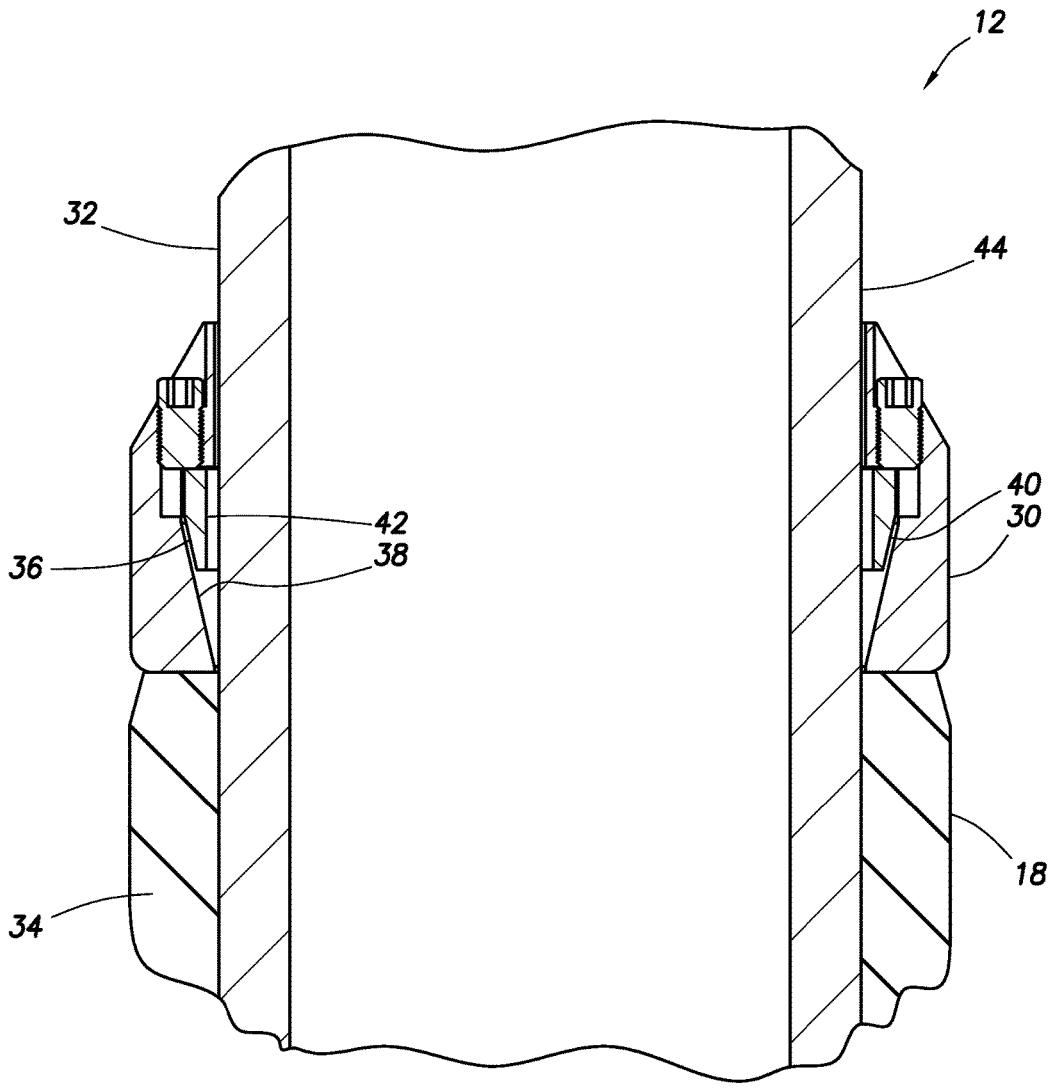
FIG. 3 is a further enlarged scale representative cross-sectional view of a portion of the packer.

A further enlarged scale cross-sectional view of a portion of the packer 12 is representatively illustrated in FIG. 3. In this view, further details of the end ring 30 and gripping device 36 may be more clearly seen.

The gripping device 36 in the FIG. 3 example is interposed radially between the end ring 30 and the base pipe 32. The gripping device 36 can adhesively bond to an exterior surface 44 on the base pipe 32 and/or to an interior surface 38 in the end ring 30.

Preferably, the gripping device 36 comprises a polymer composition material 42, which is injected into an annular space 46 formed radially between the end ring 30 and the base pipe 32, after the end ring has been positioned on the base pipe. Set screws or another type of centralizers 40 are used to centralize the end ring 30 relative to the base pipe 32.

The centralizers 40 can also retain the end rings 30 in position (longitudinally, rotationally and laterally) relative to the base pipe 32 while the polymer composition "sets" or hardens in the annular space 46 between the end ring and the base pipe. Preferably, a shear strength of the material 42 increases after it has been injected into the annular space 46.

Since the centralizers 40 may only be desired for positioning the end ring 30 on the base pipe 32, it is preferably not necessary for special materials to be used in the centralizers. For example, relatively high cost materials, such as Inconel, etc., may not be needed in the centralizers 40.

In addition, fewer centralizers 40 may be needed in the end ring 30 of the packer 12, as compared to a conventional swellable packer in which many set screws are used to prevent longitudinal displacement of a seal element and an end ring in a well.

Suitable polymer compositions for use as the material 42 can include PROTECH CRB™ and PROTECH DRB™ casing centralizer resin marketed by Halliburton Energy Services, Inc. of Duncan, Okla. USA, and BELZONE 1591™ marketed by Belzona Inc. of Miami, Fla. USA. Rubber (preferably vulcanized) can be used in the gripping device 36, if desired.

In some examples, the material 42 may comprise a swellable material so that, as the material swells, it applies an increased gripping force between the end ring 30 and the base pipe 32. The material 42 could swell prior to, during and/or after installation of the packer 12 in the wellbore 16.

In some examples, the material 42 may not be injected between the end ring 30 and the base pipe 32, and in other examples the material may not be inserted between the end ring and the base pipe after the end ring is positioned on the base pipe. Thus, it should be understood that the scope of this disclosure is not limited to the specific details of the examples described herein and depicted in the drawings.

When the gripping device 36 engages the external surface 44 on the base pipe 32, the gripping device also closes off a radial gap G between the end ring 30 and the base pipe. This can prevent extrusion of the seal element 18 through the gap G, which can increase a differential pressure resisting capability of the packer 12.

A further increase in the differential pressure resisting capability is provided by internal inclined surfaces 48 which taper radially inwardly toward opposite ends of the end ring 30. These surfaces 48 tend to compress the gripping device 36 between the end ring 30 and the base pipe 32 (and thereby increase the gripping force applied between the end ring and the base pipe) in response to longitudinal displacement of the end ring relative to the base pipe, or in response to swelling of the material 42.

A still further increase in the differential pressure resisting capability can be obtained by including reinforcement in the material 42. For example, if the shear strength of the material 42 limits the gripping capability of the device 36, inclusion of a reinforcement having an increased shear strength in the material can increase the gripping capability.

In some examples, the reinforcement could comprise very small particles, and in other examples the reinforcement could comprise relatively large elements. The relatively large elements (e.g., steel spheres, etc.) could be larger than the gap G between the end ring 30 and the base pipe 32. This can aid in closing off the gap G to extrusion, and in enhancing the shear strength of the material 42.

Figure 4:
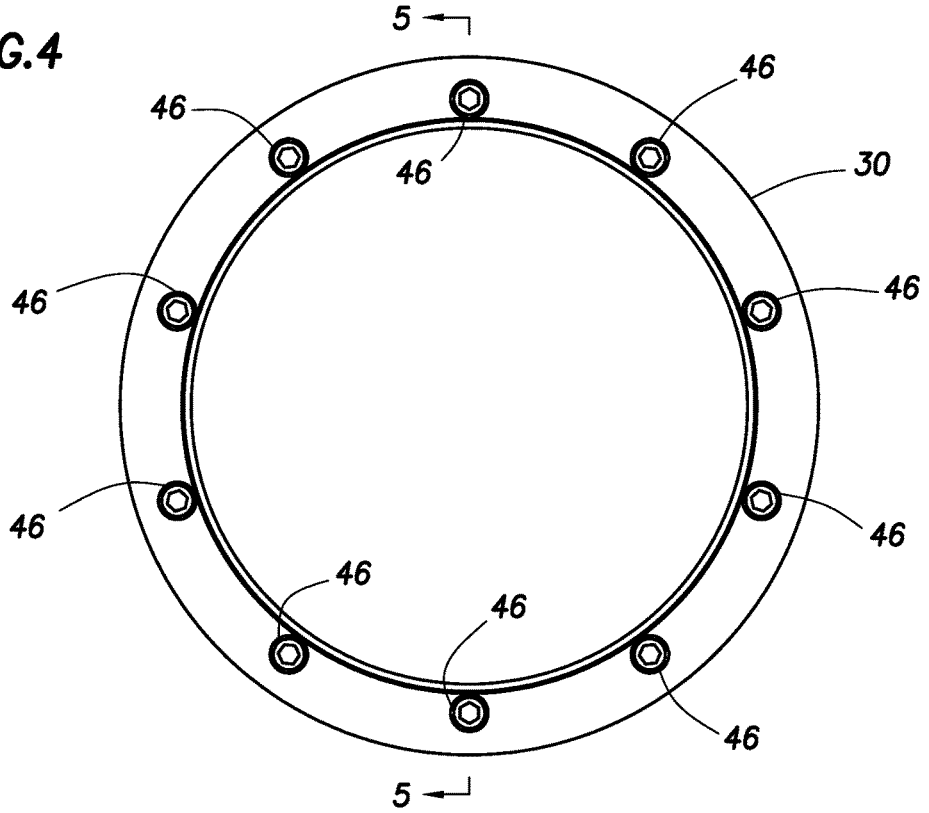
FIG. 4 is a representative cross-sectional view of an end ring of the packer.
Figure 5:
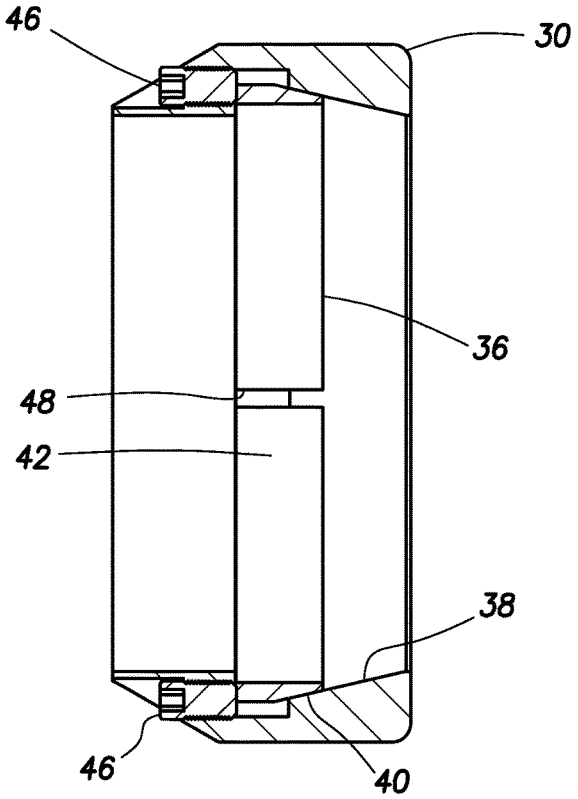

Referring additionally now to FIG. 4, the end ring 30 is representatively illustrated, apart from the packer 12. The end ring 30 may be used with packers other than the packer 12, in keeping with the scope of this disclosure.

In the FIG. 4 example, four threaded openings 50 (one of which is not visible) are used to receive the centralizers 40. Of course, if another type of centralizer is used (e.g., biasing devices, etc.), then the threaded openings 50 may not be used. Any number of the openings 50 and/or centralizers 40 may be used, as desired.

One or more of the openings 50 (or another opening, etc.) may be used to inject the material 42 into the annular space 46 between the end ring 30 and the base pipe 32. If the material 42 is not injected into the annular space 46, then another device may be used to retain the material between the end ring 30 and the base pipe 32.

It may now be fully appreciated that the above disclosure provides significant advances to the art of constructing packers for use with a well. In examples described above, the end rings 30 and gripping devices 36 can effectively retain the seal element 18 on the base pipe 32, while being economical to manufacture and convenient to install.

The above disclosure provides to the art an improved packer 12. In one example, the packer 12 can include an end ring 30 positioned proximate a seal element 18 on a base pipe 32, and a gripping device 36 positioned in an annular space 46 between the end ring 30 and the base pipe 32, the gripping device 36 comprising a polymer composition material 42.

The polymer composition material 42 may be injected between the end ring 30 and the base pipe 32. The polymer composition material 42 may set and/or harden in the annular space 46. A shear strength of the polymer composition material 42 can increase in the annular space 46.

The polymer composition material 42 can comprise a swellable material. The polymer composition material 42 may swell and thereby apply increased gripping force to the base pipe 32.

The gripping device 36 may encircle the base pipe 32 and be compressed radially inward by a surface 48 formed in the end ring 30. The gripping device 36 can increasingly grip the base pipe 32 in response to longitudinal displacement of the end ring 30 relative to the base pipe 32.

The seal element 18 can comprise a swellable material which swells in response to contact with a fluid.

The gripping device 36 may close off a gap G formed radially between the base pipe 32 and the end ring 30.

The packer can also include a reinforcement in the polymer composition material 42. The reinforcement can have a dimension larger than the gap G formed radially between the base pipe 32 and the end ring 30.

A method of constructing a packer 12 is also described above. In one example, the method can include positioning an end ring 30 on a base pipe 32, and then injecting a gripping device 36 into an annular space 46 between the end ring 30 and the base pipe 32, whereby the gripping device 36 grips the base pipe 32.

The method can also include the gripping device 36 swelling, thereby increasing a gripping force applied by the gripping device 36 to the base pipe 32.

Another method of constructing a packer 12 is described above. The method can include positioning an end ring 30 on a base pipe 32, and positioning a gripping device 36 in an annular space 46 between the end ring 30 and the base pipe 32, so that the gripping device 36 grips the base pipe 32, the gripping device 36 comprising a polymer composition material 42.

The gripping device positioning can be performed after the end ring positioning. The gripping device positioning may be performed concurrently with the end ring positioning.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A packer, comprising:

an end ring positioned proximate a seal element on a base pipe;

a gripping device positioned in an annular space between the end ring and the base pipe, the gripping device comprising a polymer composition material, wherein the gripping device adhesively bonds to an exterior surface of the base pipe and to an interior surface of the end ring; and at least one centralizer configured to centralize the end ring relative to the base pipe while the polymer composition sets in the annular space, wherein the gripping device encircles the base pipe and is compressed radially inward by inclined surfaces formed in the end ring, the inclined surfaces configured to taper inwardly toward opposite ends of the end ring.

2. The packer of claim 1, wherein the polymer composition material is injected between the end ring and the base pipe.

3. The packer of claim 1, wherein the polymer composition material hardens in the annular space.

4. The packer of claim 1, wherein a shear strength of the polymer composition material increases in the annular space.

5. The packer of claim 1, wherein the polymer composition material comprises a swellable material.

6. The packer of claim 1, wherein the polymer composition material swells and thereby applies increased gripping force to the base pipe.

7. The packer of claim 1, wherein the gripping device encircles the base pipe and is compressed radially inward by a surface formed in the end ring.

8. The packer of claim 7, wherein the gripping device increasingly grips the base pipe in response to longitudinal displacement of the end ring relative to the base pipe.

9. The packer of claim 1, wherein the seal element comprises a swellable material which swells in response to contact with a fluid.

10. The packer of claim 1, wherein the gripping device closes off a gap formed radially between the base pipe and the end ring.

11. The packer of claim 1, further comprising a reinforcement in the polymer composition material.

12. The packer of claim 11, wherein the reinforcement has a dimension larger than a gap formed radially between the base pipe and the end ring.

13. The packer of claim 11, wherein the reinforcement comprises at least one of small particles and large elements.

14. The packer of claim 1, wherein the polymer composition material includes a reinforcement in the polymer composition material, the reinforcement including spheres having a dimension larger than a gap formed radially between the base pipe and the end ring.

15. A method of constructing a packer, the method comprising:

positioning an end ring on a base pipe; and then injecting a gripping device into an annular space between the end ring and the base pipe, whereby the gripping device grips the base pipe, wherein the gripping device adhesively bonds to an exterior surface of the base pipe and to an interior surface of the end ring;

wherein the end ring comprises at least one centralizer configured to centralize the end ring relative to the base pipe while the gripping device sets in the annular space, and wherein the gripping device encircles the base pipe and is compressed radially inward by inclined surfaces formed in the end ring, the inclined surfaces configured to taper inwardly toward opposite ends of the end ring.

16. The method of claim 15, further comprising the gripping device swelling, thereby increasing a gripping force applied by the gripping device to the base pipe.

17. The method of claim 15, further comprising the gripping device closing off a gap formed radially between the base pipe and the end ring.

18. The method of claim 15, further comprising the gripping device being compressed radially inward by a surface formed in the end ring, the surface encircling the base pipe.

19. The method of claim 18, further comprising the gripping device increasingly gripping the base pipe in response to longitudinal displacement of the end ring relative to the base pipe.

20. The method of claim 15 wherein the gripping device comprises a polymer composition material.

21. The method of claim 15, further comprising a material of the gripping device hardening in the annular space.

22. The method of claim 15, further comprising a shear strength of a material of the gripping device increasing in the annular space.

23. The method of claim 15, wherein the end ring restricts longitudinal displacement of a seal element relative to the base pipe, and wherein the seal element comprises a swellable material which swells in response to contact with a fluid.

24. The method of claim 15, further comprising a reinforcement in a material of the gripping device.

25. The method of claim 24, wherein the reinforcement has a dimension larger than a gap formed radially between the base pipe and the end ring.

26. A method of constructing a packer, the method comprising:

positioning an end ring on a base pipe; and positioning a gripping device in an annular space between the end ring and the base pipe, so that the gripping device grips the base pipe, the gripping device comprising a polymer composition material, wherein the gripping device adhesively bonds to an exterior surface of the base pipe and to an interior surface of the end ring;

wherein the end ring comprises at least one centralizer configured to centralize the end ring relative to the base pipe while the polymer composition sets in the annular space, and wherein the gripping device encircles the base pipe and is compressed radially inward by inclined surfaces formed in the end ring, the inclined surfaces configured to taper inwardly toward opposite ends of the end ring.

27. The method of claim 26, wherein the gripping device positioning is performed after the end ring positioning.

28. The method of claim 26, wherein the gripping device positioning is performed concurrently with the end ring positioning.

29. The method of claim 26, wherein the gripping device positioning further comprises injecting the polymer composition material into the annular space.

30. The method of claim 26, further comprising the polymer composition material swelling, thereby increasing a gripping force applied by the gripping device.

31. The method of claim 26, further comprising the gripping device closing off a gap formed radially between the base pipe and the end ring.

32. The method of claim 26, further comprising the gripping device being compressed radially inward by a surface formed in the end ring, the surface encircling the base pipe.

33. The method of claim 26, further comprising the gripping device increasingly gripping the base pipe in response to longitudinal displacement of the end ring relative to the base pipe.

34. The method of claim 26, further comprising the polymer composition material hardening in the annular space.

35. The method of claim 26, further comprising a shear strength of the polymer composition material increasing in the annular space.

36. The method of claim 26, wherein the end ring restricts longitudinal displacement of a seal element relative to the base pipe, and wherein the seal element comprises a swellable material which swells in response to contact with a fluid.

37. The method of claim 26, further comprising a reinforcement in the polymer composition material.

38. The method of claim 37, wherein the reinforcement has a dimension larger than a gap formed radially between the base pipe and the end ring.

* * * * *